US007552774B2

(12) United States Patent
Anderson et al.

(10) Patent No.: US 7,552,774 B2
(45) Date of Patent: Jun. 30, 2009

(54) CONTROL LINE HYDROSTATIC MINIMALLY SENSITIVE CONTROL SYSTEM

(75) Inventors: David Z. Anderson, Glenpool, OK (US); Edward W. Welch, Jr., Broken Arrow, OK (US); Alan N. Wagner, Broken Arrow, OK (US); Darren E. Bane, Broken Arrow, OK (US); Clifford H. Beall, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 301 days.

(21) Appl. No.: 11/633,799

(22) Filed: Dec. 5, 2006

(65) Prior Publication Data

US 2008/0128137 A1 Jun. 5, 2008

(51) Int. Cl.
*E21B 34/10* (2006.01)
*F16K 31/122* (2006.01)

(52) U.S. Cl. ..... 166/319; 166/321; 166/332.1; 251/62

(58) Field of Classification Search ..... 166/373–375, 166/319, 321, 325, 332.1, 332.8; 251/12, 251/62, 303, 336, 339
See application file for complete search history.

(56) References Cited

U.S. PATENT DOCUMENTS 4,005,751 A * 2/1977 Page, Jr. ..... 166/321
4,119,146 A * 10/1978 Taylor ..... 166/72
4,373,587 A * 2/1983 Pringle ..... 166/324
4,791,990 A * 12/1988 Amani ..... 166/311
5,564,501 A 10/1996 Strattan et al.
5,906,220 A * 5/1999 Thompson ..... 137/492.5
6,109,351 A 8/2000 Beall
6,427,778 B1 8/2002 Beall et al.
6,866,101 B2 * 3/2005 Sloan ..... 166/375
2003/0168219 A1 9/2003 Sloan

FOREIGN PATENT DOCUMENTS

GB 2322652 A 9/1998
GB 2371060 A 7/2002
GB 2418939 A 4/2006
GB 2419363 A 4/2006
GB 2423780 A 9/2006

* cited by examiner

*Primary Examiner*—Kenneth Thompson
(74) *Attorney, Agent, or Firm*—Steve Rosenblatt

(57) ABSTRACT

A control system for a downhole tool, such as a subsurface safety valve, features an operating piston that is insensitive to tubing pressure in the valve. The hydrostatic forces from the single control line from the surface are significantly reduced with a branch line to a piston bottom that is slightly smaller than the piston top. A variable volume between piston seals is connected to a low pressure compressible fluid reservoir to permit piston movement. The piston can be modular to facilitate assembly or bore offsets in the valve body. Failsafe closure upon seal failures is contemplated.

20 Claims, 1 Drawing Sheet

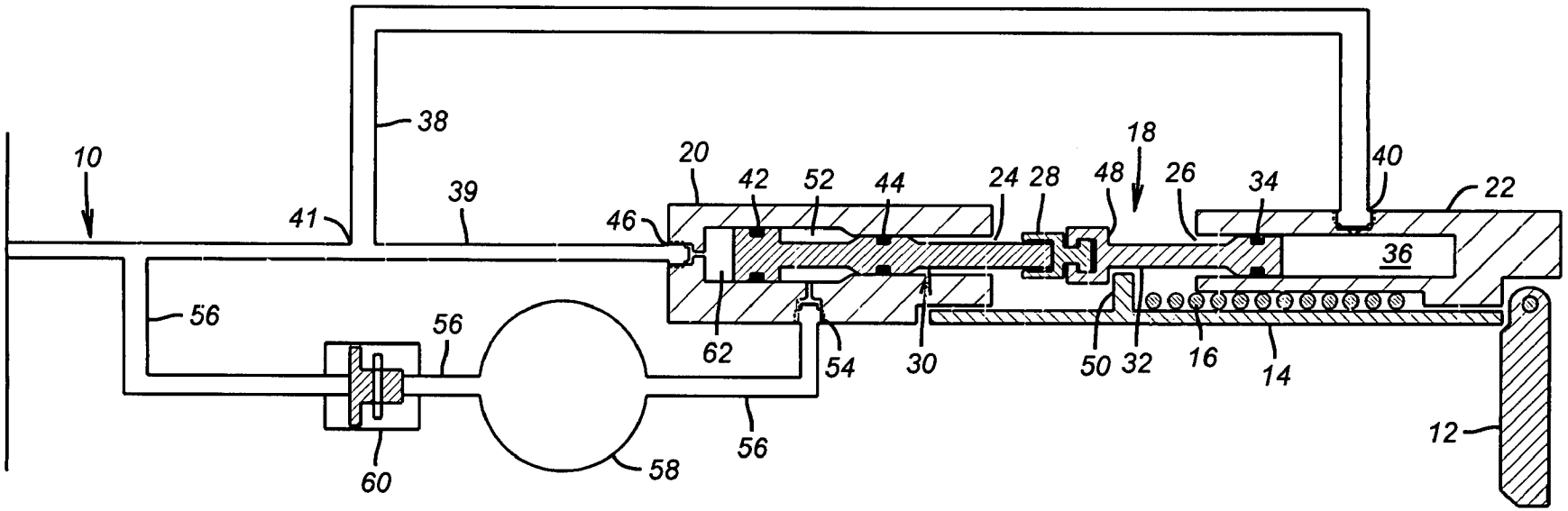
22
40
36
34
26
18
48
28
24
44
52
42
20
46
39
38
41
10
12
14
16
32
50
30
54
56
62
58
56
60
56

CONTROL LINE HYDROSTATIC MINIMALLY SENSITIVE CONTROL SYSTEM

FIELD OF THE INVENTION

The field of this invention is control systems for downhole valves and more particularly for subsurface safety valves where the system is tubing pressure insensitive.

BACKGROUND OF THE INVENTION

Subsurface safety valves are used in wells to close them off in the event of an uncontrolled condition to ensure the safety of surface personnel and prevent property damage and pollution. Typically these valves comprise a flapper, which is the closure element and is pivotally mounted to rotate 90 degrees between an open and a closed position. A hollow tube called a flow tube is actuated downwardly against the flapper to rotate it to a position behind the tube and off its seat. That is the open position. When the flow tube is retracted the flapper is urged by a spring mounted to its pivot rod to rotate to the closed position against a similarly shaped seat.

The flow tube is operated by a hydraulic control system that includes a control line from the surface to one side of a piston. Increasing pressure in the control line moves the piston in one direction and shifts the flow tube with it. This movement occurs against a closure spring that is generally sized to offset the hydrostatic pressure in the control line, friction losses on the piston seals and the weight of the components to be moved in an opposite direction to shift the flow tube up and away from the flapper so that the flapper can swing shut.

Normally, it is desirable to have the flapper go to a closed position in the event of failure modes in the hydraulic control system and during normal operation on loss or removal of control line pressure. The need to meet normal and failure mode requirements in a tubing pressure insensitive control system, particularly in a deep set safety valve application, has presented a challenge in the past. The results represent a variety of approaches that have added complexity to the design by including features to. insure the fail safe position is obtained regardless of which seals leak. Some of these systems have overlays of pilot pistons and several pressurized gas reservoirs while others require multiple control lines from the surface in part to offset the pressure from control line hydrostatic pressure. Some recent examples of these efforts can be seen in U.S. Pat. Nos. 6,427,778 and 6,109,351.

Despite these efforts a tubing pressure insensitive control system for deep set safety valves that had greater simplicity, enhanced reliability and lower production cost remained a goal to be accomplished. The present invention provides for a tubing pressure insensitive operating piston. It neutralizes the hydrostatic forces in the control line to a significant extent while running a single control line to the surface. It provides a low pressure compressed gas volume to allow the piston to move when such movement reduces the volume of a cavity between piston seals. These and other features of the present invention will become more apparent to those skilled in the art from a review of the description of the preferred embodiment and the associated drawing of the control system, while recognizing that the full scope of the invention is to be found in the claims.

SUMMARY OF THE INVENTION

A control system for a downhole tool, such as a subsurface safety valve, features an operating piston that is insensitive to tubing pressure in the valve. The hydrostatic forces from the single control line from the surface are significantly reduced with a branch line to a piston bottom that is slightly smaller than the piston top. A variable volume between piston seals is connected to a low pressure compressible fluid reservoir to permit piston movement. The piston can be modular to facilitate assembly or bore offsets in the valve body. Failsafe closure upon seal failures is contemplated.

BRIEF DESCRIPTION OF THE DRAWING

FIG. 1 is a schematic system diagram of the control system.

DETAILED DESCRIPTION OF THE PREFERRED EMBODIMENT

The present invention can be used as a control system for a subsurface safety valve (SSSV) or for that matter other types of downhole tools that are hydraulically operated from the surface, generally via a control line 10. In a SSSV application the end component is a flapper 12 that is pushed open by a flow tube 14 that moves against the bias of a power spring 16. Since the present invention has applications beyond SSSVs any reference to flow tube is intended to generically refer to a part of a tool that is actuated by a piston assembly 18 of a control system. Since those skilled in the art are well aware of common components of SSSVs, they are omitted from the drawing to allow greater clarity in understanding the operation of the control system. For example, it is well known that the flapper 12 in the position shown in FIG. 1 is in the closed position against a seat that surrounds a passage in a valve housing. That passage is exposed to internal tubing pressure while being isolated from pressure in the control line 10. The flow tube 14 and parts of the piston assembly 18 are similarly exposed to tubing pressure in the passage. Only a portion of the valve housing adjacent the piston assembly 18 is shown for clarity.

With that as an introduction, it can be seen that an upper housing 20 is juxtaposed opposite a lower housing 22. They may be in one piece or two pieces that are connected. There are opposed spaced bores 24 and 26 that accept the piston assembly 18. Preferably, the bores 24 and 26 are aligned but some offset can be accommodated with a modular design of the piston assembly 18. A connector 28 can be used to connect upper piston 30 to lower piston 32. Due to the channels at the ends of connector 28 the upper piston 30 can be connected to the lower piston 32 with a centerline offset. Although a rod piston design is preferred, other piston shapes are contemplated.

Lower piston 32 has a seal 34 to define a third variable volume chamber 36. Control line 10 has a branch 38 connected at connection 40 to chamber 36 and a branch 39 connected to connection 46. They form a junction 41 in close proximity to upper housing 20. Options exist as to how to route branch 38. It can be routed so that connection 40 is exposed to tubing pressure that affects the flow tube 14 and the flapper 12, for example. Optionally, branch 38 can be routed outside the valve housing in the surrounding annular space. Depending on what choice is made there will be different considerations regarding how the system responds if a component fails, as will be explained below. The preferred embodiment is to run branch 38 to connection 40 along a route that has exposure to either tubing pressure or annulus pressure with annulus pressure preferred to assure desired failure modes in the event of leakage.

Pressure applied to the control line 10 goes through branch 38 to chamber 36 where it will exert an uphole force on lower piston 32. Upper piston 30 has a seal 42 that is a larger diameter than seal 34. Upper piston 30 has another seal 44 that is preferably the same or very close to the same size as seal 34. Since both seals 44 and 34 are on the piston assembly 18 and are exposed on one side to the same tubing pressure, the piston assembly 18 experiences no net force from exposure to tubing pressure and can be referred to as tubing pressure insensitive for that reason. However, seal 42 is made larger than seal 34 by design and both are exposed to pressure in control line 10 and its branch 38. While there is but a single control line 10 that runs from the surface that terminates at connections 40 and 46, it can be seen that hydrostatic pressure in control line 10 is substantially offset by this arrangement. There is a net force from hydrostatic pressure in control line 10 on the piston assembly 18 in a downhole direction equal to the pressure near the connections 40 and 46, which should be identical, divided by the area difference of seal 34 subtracted from the area of seal 42. Of course, on application of pressure to control line 10 the net downhole force on piston assembly 18 increases to overcome the power spring 16 to shift the piston assembly 18 until shoulder 48 on the lower piston 32 engages shoulder 50 on flow tube 14 to rotate the flapper 12 to the open position.

In between seals 42 and 44 is a first variable volume chamber 52 that gets smaller as the piston assembly 18 is displaced against spring 16. In order to allow the piston assembly 18 to move in that direction without getting bound, connection 54 has a line 56 leading to a reservoir 58 which is preferably at least 4 times the volume of chamber 52. Line 56 continues to a valve 60 that is normally closed and whose purpose will be later explained. Beyond valve 60 line 56 ties into control line 10. Reservoir 58 is preferably at atmospheric pressure or slightly higher and contains a compressible fluid. In normal operation, movement of the piston assembly 18 against spring 16 slightly raises the pressure in reservoir 58 to a degree related to the volume ratios between chamber 52 and reservoir 58 but in no way measurably impeding the movement of piston assembly 18.

If there is a seal failure of seal 34 high tubing pressure can get into chamber 36 and from there through connection 40 and branch 38 to connection 46 and into chamber 62. Since the pressure is now the same in third chamber 36 and second chamber 62 (i.e. tubing pressure)there would be a net opening force on piston assembly 18 due to the diameter of seal 42 being larger than the diameter of seal 34 (that has now failed). Without valve 60 in the system, the flapper 12 could be held open upon failure of seal 34 or, for that matter, failure of connections 40 and 46. Valve 60 senses a pressure buildup in line 56 that occurs due to failure of seal 34 and tubing pressure migrating that far through branch 38. Valve 60 can be a rupture disc or a piston held by a pin that shears or any other equivalent device that goes open at a predetermined pressure. When valve 60 opens the pressure at connections 46 and 54 equalizes removing any influence of tubing pressure on the piston assembly 18 that occurred due to failure of seal 34. At that point the spring 16 pushes the piston assembly 18 to the valve closed position shown in FIG. 1. From that point the piston assembly 18 can no longer be operated from control line 10 and flapper 12 is in its fail safe closed position.

Those skilled in the art will appreciate that the present invention illustrates a downhole tool control system that can run off a single control line from the surface 10 and that is further configured to address opposing ends of a piston assembly in a way that minimizes the effect of control line hydrostatic pressure. This reduction of the net effect of hydrostatic pressure despite use of a single control line to the surface allows the use of a lower pressure to move the piston assembly 18. Differing diameters of the opposed ends of the piston assembly allow a sufficient net opening force to be applied to move the piston assembly 18 against the spring 16. The piston assembly is insensitive to tubing pressure which dramatically lowers the required opening pressure as compared to conventional subsurface safety valves. The movement of the piston assembly 18 reduces the volume of a chamber 52 but with the addition of a reservoir of fairly large volume the resistance to movement from the compression effect of volume reduction in chamber 52 is made insignificant by the presence of large reservoir 58 which operates at an initial pressure that is close to atmospheric. With very high tubing pressures in the order of 20,000 PSI or more seals 44 and 34 see fairly large pressure differentials to help them seal more effectively. Failure of seal 34, connection 40, or connection 46 opens valve 60 to equalize pressure across seal 42 to let the spring 16 urge the flapper 12 to the fail safe closed position. Piston bores 24 and 26 may have a misalignment that can be compensated for by making the piston assembly 18 modular using a connector 28 that tolerates offset between the upper piston 30 and the lower piston 32.

The above description is illustrative of the preferred embodiment and various alternatives and is not intended to embody the broadest scope of the invention, which is determined from the claims appended below, and properly given their full scope literally and equivalently.

We claim:

1. A control system for a downhole valve operated from the surface, comprising:

a housing having a though bore to contain tubing pressure and a valve member therein movable between an open and a closed position;

a piston assembly, in a wall that forms said housing, having an upper and a lower end and operably connected to said valve member;

a first connection in said housing in fluid communication with said upper end of said piston assembly and a second connection in said housing in fluid communication with said lower end of said piston assembly, an always open passage between said first and second connections to provide offsetting forces on said piston assembly from pressure in said passage.

2. The system of claim 1, further comprising:

a single control line from the surface connected to said passage.

3. The system of claim 1, wherein:

said passage is at least in part exposed to pressure in said through bore.

4. The system of claim 1, wherein:

said passage extends substantially in said wall of said housing.

5. A control system for a downhole valve operated from the surface, comprising:

a housing having a though bore to contain tubing pressure and a valve member therein;

a piston assembly, in a wall that forms said housing, having an upper and a lower end and operably connected to said valve member;

a first connection in said housing in fluid communication with said upper end of said piston assembly and a second connection in said housing in fluid communication with said lower end of said piston assembly, a passage between said first and second connections to provide offsetting forces on said piston assembly from pressure in said passage;

said upper and lower ends of said piston assembly have different diameters.

6. The system of claim 5, wherein:

said piston assembly is disposed in upper and lower opposed and spaced bores and further comprises an upper bore seal and a lower bore seal exposed to tubing pressure.

7. The system of claim 6, wherein:

said upper and lower bore seals exposed to tubing pressure are substantially the same dimension, making said piston assembly insensitive to tubing pressure.

8. The system of claim 7, wherein:

said piston assembly comprises a control line pressure seal in said upper bore having a larger dimension than said upper bore seal.

9. The system of claim 8, wherein:

said control line pressure seal and said upper bore seal define a first variable volume chamber in said upper bore, said first variable volume chamber containing a compressible fluid.

10. The system of claim 9, wherein:

said first variable volume chamber in fluid communication with a larger reservoir.

11. The system of claim 10, wherein:

said reservoir operates at least at atmospheric pressure.

12. The system of claim 10, wherein:

said control line pressure seal defines a second variable volume chamber in said upper bore accessed through said first connection;

said lower bore seal defines a third variable volume chamber in said lower bore accessed by said second connection.

13. The system of claim 12, wherein:

said reservoir is in selective flow communication with said passage.

14. The system of claim 13, wherein:

said selective flow communication between said reservoir and said passage comprises a pressure sensitive normally closed valve.

15. The system of claim 14, wherein:

said normally closed valve comprises a rupture disc.

16. The system of claim 15, wherein:

said piston assembly comprises two parts joined by a connector that can accommodate misalignment of said bores.

17. The system of claim 16, wherein:

said piston assembly is operatively engaged, between said spaced bores, to a biased flow tube that is operably connected to said valve member that comprises a flapper.

18. The system of claim 10, wherein:

said reservoir is at least as large as the volume of said first variable volume chamber.

19. The system of claim 12, wherein:

failure of said lower bore seal puts said piston assembly in a position where said valve member is closed.

20. The system of claim 14, wherein:

failure of said lower bore seal or said first or second connection pressurizes said passage and opens said pressure sensitive normally closed valve.

* * * * *